US007993162B1

(12) United States Patent
Scholeno

(10) Patent No.: US 7,993,162 B1
(45) Date of Patent: Aug. 9, 2011

(54) LAMP SOCKET HAVING CONTACT AND BACKUP SPRING

(75) Inventor: Michael F. Scholeno, York, PA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 0 days.

(21) Appl. No.: 12/800,027

(22) Filed: May 6, 2010

(51) Int. Cl.
*H01R 33/09* (2006.01)

(52) U.S. Cl. ..... 439/619; 439/699.2

(58) Field of Classification Search ..... 439/616, 439/619, 699.1, 699.2, 833, 839
See application file for complete search history.

(56) References Cited

U.S. PATENT DOCUMENTS

| | | | | |
|---|---|---|---|---|
| 2,459,647 | A | 1/1949 | Hodgkins | |
| 2,663,852 | A | 12/1953 | Kershaw | |
| 3,678,174 | A | 7/1972 | Ganzhorn | |
| 3,880,494 | A * | 4/1975 | Reed et al. | 439/517 |
| 3,897,124 | A | 7/1975 | Pagnotta et al. | |
| 4,256,989 | A | 3/1981 | Trutner et al. | |
| 4,729,073 | A | 3/1988 | Klaus | |
| 4,885,435 | A | 12/1989 | Dix et al. | |
| 5,568,009 | A | 10/1996 | Gandhi | |
| 5,767,617 | A | 6/1998 | Wharmby et al. | |
| 6,932,491 | B2 | 8/2005 | Esakoff | |
| 7,025,634 | B1 * | 4/2006 | Swantner et al. | 439/619 |
| 7,441,939 | B2 | 10/2008 | Scholeno | |
| 7,731,545 | B1 | 6/2010 | Scholeno | |
| 2008/0094856 | A1 | 4/2008 | Garcia et al. | |
| 2008/0136307 | A1 | 6/2008 | Garcia et al. | |

FOREIGN PATENT DOCUMENTS

| | | | |
|---|---|---|---|
| GB | 850069 | | 9/1960 |
| WO | 03056237 | A1 | 7/2003 |
| WO | 2005025014 | A1 | 3/2005 |

OTHER PUBLICATIONS

Socket description, Bender & Wirth, Fassung (Lampholder) PGJ28 and PGJX28, Fassungstechnik, 1 page dated Nov. 23, 2007.

* cited by examiner

*Primary Examiner* — Ross Gushi
(74) *Attorney, Agent, or Firm* — Edward S. Podszus

(57) ABSTRACT

An electrical contact (100) for a lamp (10) that includes electrical lead-ins (20) projecting away from a longitudinal lamp axis (40), said electrical contact (100) has a first electrically conductive segment (110) including a first segment (120) leading to a first reentrant portion (130), a first beam (140) that extends from the first reentrant portion (130) to an electrical lead-in engager (150), and a second reentrant portion (160) that connects to a second beam (170) that at least partially extends over the electrical lead-in engager (150). A back-up spring (220) is provided having a configuration substantially conforming to the conductive segment (110). The back-up spring has a spring first segment (240) that leads to a first spring reentrant portion (250), thereafter to a first spring beam (260) that extends from the first spring reentrant portion (250) to a junction (261) at a region adjacent the electrical lead-in engager (150), the junction (261) connecting, in turn, the first spring beam (260) to a second spring reentrant portion (270), the second spring reentrant portion (270) connecting to a second spring beam (280) that abuts the second beam (170) of the conductive segment (110). The electrical contact (100) is preferably employed in combination with a socket (101) for receiving a lamp (10), the socket (101) formed of a first socket body portion (141) and a second socket body portion (147), with the electrical contact (100) being disposed between the first and second body portions.

12 Claims, 5 Drawing Sheets

LAMP SOCKET HAVING CONTACT AND BACKUP SPRING

CROSS-REFERENCE TO RELATED APPLICATIONS

There is no cross-reference to a related application.

GOVERNMENT CONTRACT

This invention was not made under any government contract and the United States Government has no rights under this invention.

TECHNICAL FIELD

This invention relates to lamp sockets and more particularly to an electrical contact for use in such sockets.

BACKGROUND ART

The mounting and connection of high-power lamps in ceramic sockets has presented many problems over the years. The use of ceramic materials, which have greater tolerances than counterpart plastic materials, has necessitated great complexity in the contacts employed in order to ensure both adequate electrical contact as well as mechanical holding ability. Often, in high-power lamps, the electrical lead-ins extend in a direction normal to the lamp axis and, this, too, has presented problems in the maintenance of good electrical contact and in holding ability. Known in the art are PCT Publications WO 03/056237 (Tiesler-Wittig et al.) and WO 2005/025014 (Verspaget et al.).

DISCLOSURE OF INVENTION

In one aspect, there is provided improved electrical contacts in sockets that receive lamps having electrical lead-ins projecting away from, such as perpendicular to, the lamp's longitudinal axis.

The electrical contact comprises a first electrically conductive segment that includes a first segment leading to a first reentrant portion, a first beam extending from the first reentrant portion to an electrical lead-in engager, a second reentrant portion connecting to a second beam that at least partially extends over the electrical lead-in engager, and a back-up spring having a configuration substantially conforming to the electrical contact and having a spring first segment leading to a first spring reentrant portion, a first spring beam extending from the first spring reentrant portion to a position adjacent the electrical lead-in engager, and a second spring reentrant portion connecting to a second spring beam that abuts the second beam.

The electrically conductive contact and the back-up spring, being in laminate relation, can use two different materials, wherein the contact material can be chosen for its, conductivity and the back-up spring can be chosen for its tension-providing qualities.

BEST MODE FOR CARRYING OUT THE INVENTION

Figure 1:
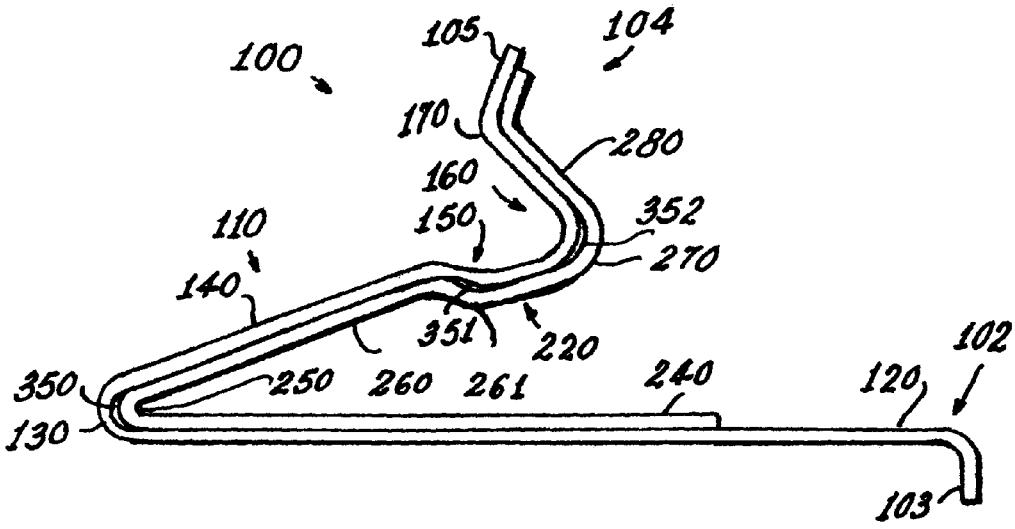
FIG. 1 is an elevation view of an embodiment of the invention.

For purposes of this application it is to be understood that when an element or layer is referred to as being "on," "connected to" or "coupled to" another element or layer, it can be directly on, connected to or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. The term "and/or" includes any and all combinations of one or more of the associated listed items.

Although the terms "first," "second," "third," "proximal" or "distal," etc. may be used to describe various elements, components, regions, layers and/or sections, these elements, components, regions, layers and/or sections are not to be limited by theses terms as they are used only to distinguish one element, component, region, layer or section from another element, component, region, layer or section. Thus, a first element, component, region, layer or section could be termed a second element, component, region, layer or section without departing from the scope and teachings of the present invention.

Spatially relative terms, such as "beneath," "below," "upper," "lower," "above" and the like may be used herein for ease of description to describe one element or feature's relationship to another element(s) or feature(s) as illustrated in the drawings. These spatially relative terms are intended to encompass different orientations of the device in use or operation in addition to the orientation shown in the drawings. For example, if the device in the drawings is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. For example, as used herein, the singular forms "a," "an" and "the" are intended to include the plural forms as well, unless the context clearly indicates otherwise. It will be further understood that the terms, "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

For a better understanding of the present invention, together with other and further objects, advantages and capabilities thereof, reference is made to the following disclosure and appended claims taken in conjunction with the above-described drawings.

Figure 6:
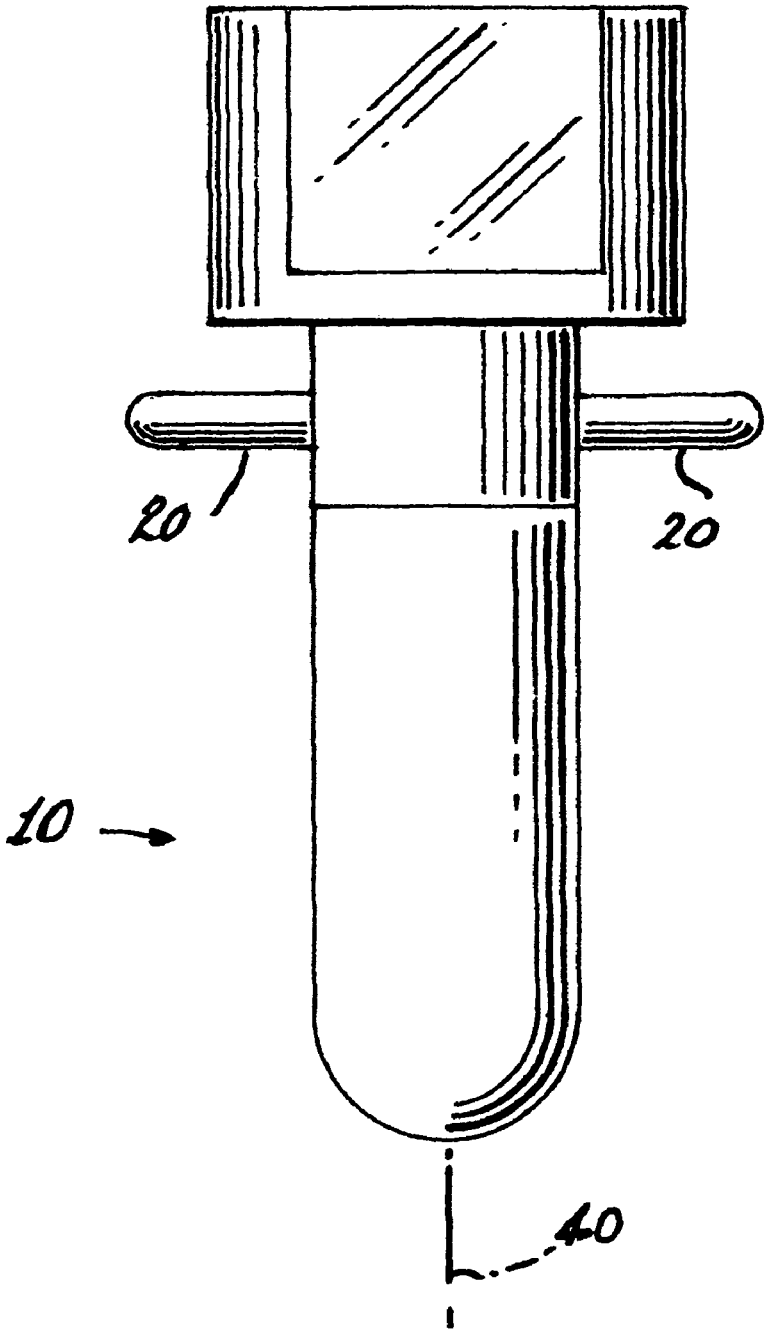
Fig. 6 Prior Art
FIG. 6 is an elevation view of a lamp that can be employed with the contact and socket of the invention.

Referring now to the drawings with greater particularity, there is shown in FIG. 1 an electrical contact 100 for a lamp 10 that includes electrical lead-ins 20 projecting away from a longitudinal lamp axis 40. The lamp is shown in FIG. 6, and such lamps are per se conventional in the art.

Figure 2:
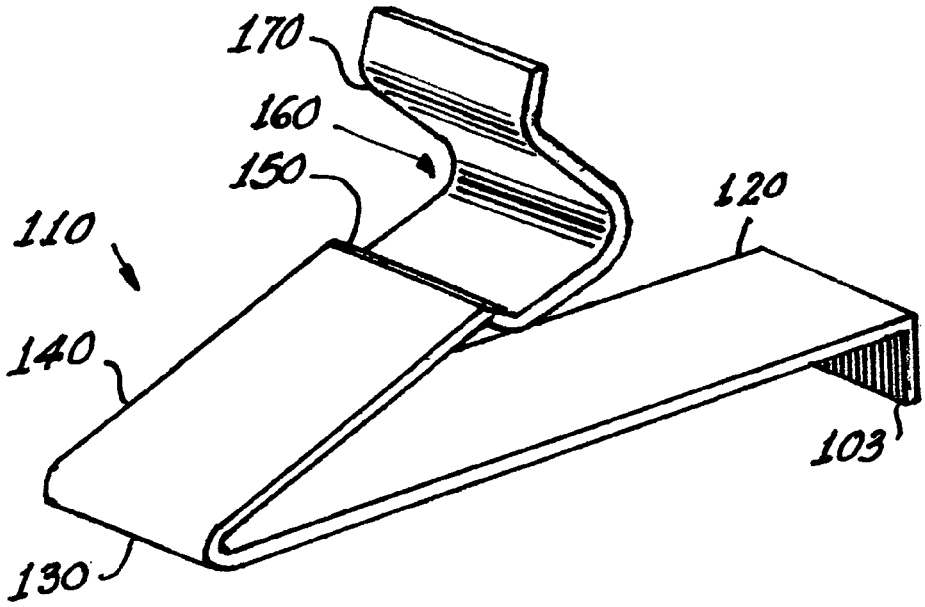
FIG. 2 is a perspective view of the electrical contact portion of a contact in accordance with an embodiment of the invention.
Figure 3:
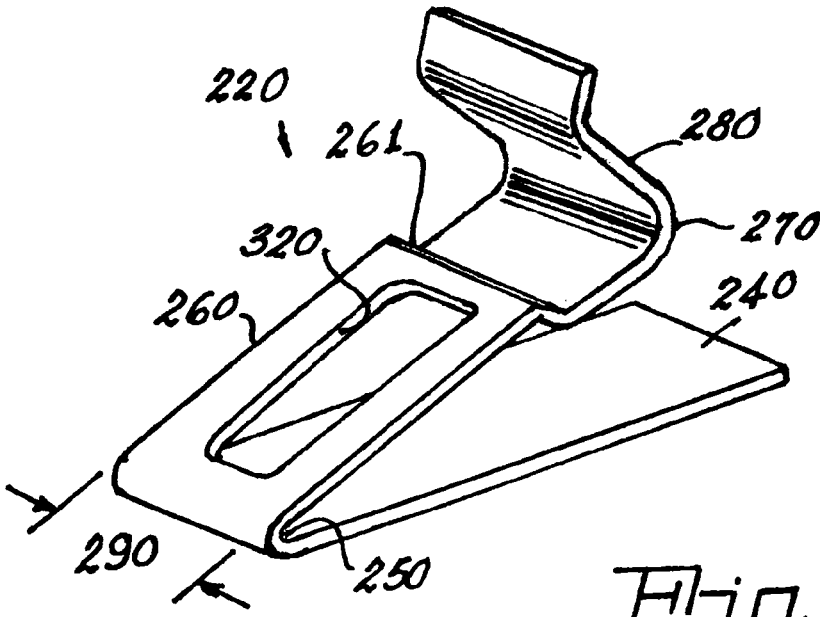
FIG. 3 is a perspective view of a first embodiment of a back-up spring for use in an embodiment of the invention.

Referring to FIG. 1 and FIG. 2, electrical contact 100 is comprised of two elements, a first electrically conductive segment 110 and a back-up spring 220 that are illustrated individually in FIGS. 2 and 3. The first electrically conductive segment 110 comprises a first segment 120 that leads to a first reentrant portion 130. A first beam 140 extends from the first reentrant portion 130 to an electrical lead-in engager 150 and a second reentrant portion 160 connects to a second beam 170 that at least partially extends over the electrical lead-in engager 150. The lead-in engager 150, the second reentrant portion 160 and the second beam 170 form a pocket that engages the electrical lead-ins 20 of the lamp 10, as will be explained hereinafter.

Referring to FIG. 3, back-up spring 220 has a configuration substantially conforming to conductive segment 110 and has a spring first segment 240 leading to a first spring reentrant portion 250 and a first spring beam 260 extending from the first spring reentrant portion 250 to a junction 261. The junction 261 connects the first spring beam 260 to a second spring reentrant portion 270 that, in turn, connects to a second spring beam 280 that abuts the second beam 170.

A plurality of gaps exist, each defined at various places between the conductive segment 110 and the back-up spring 220, to prevent binding and to ensure that the load location is generally always at the same location. A first gap 350 is present between a portion of the first electrically conductive segment 110 and a portion of the back-up spring 220 at the region of the first reentrant portion 130; a second gap 351 is present between a portion of the electrical lead-in engager 150 of the electrically conductive segment 110 and a portion of the junction 261 of the back-up spring 220; and a third gap 352 is present between a portion of the second beam 170 and a portion of the second spring re-entrant portion 270 at the region of the second reentrant portion 160 of the conductive segment 110. It is understood that in order to modulate the loading behavior, the contact 100 and spring 220 can be so formed as to have any one of these first, second and third gaps and not the others, or any two of the gaps and not the other.

Figure 5:
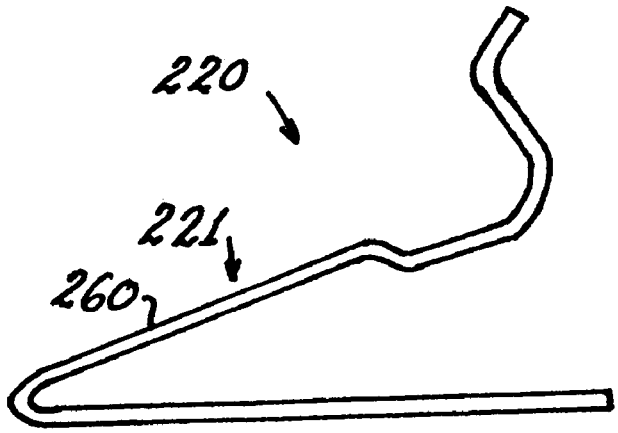
FIG. 5 is an elevation view of yet another embodiment of a back-up spring.

The first spring beam 260 is formed to provide a pre-selected force to the back-up spring 220 and can take any one of several forms. For example, as shown in FIG. 5 the back-up spring 220, and thus the first spring beam 260, can be formed from a single strand wire spring.

Figure 4:
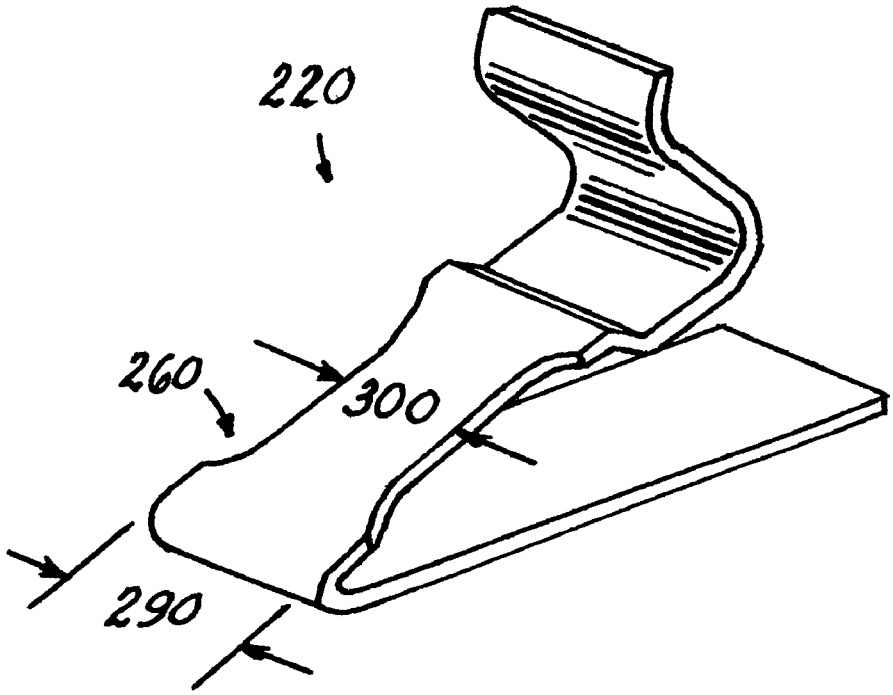
FIG. 4 is a perspective view of an alternate embodiment of a back-up spring.

In the embodiment of FIG. 4 the first spring beam 260 comprises a region having a first width 290 adjacent a region defining a neck 300 having a neck width less than the first width 290, where the neck width is selected to exert a force.

In the embodiment of FIG. 3 the first spring beam 260 defines a cutout 320 formed therein, wherein dimensions of the cutout 320 are chosen to select a force by the back-up spring 220 on the conductive segment 110.

The contact 100 has a proximal portion 102 including a first locating tab 103 and a distal portion 104 including a second locating tab 105 which tabs are used to located the contact 100 within a socket, as will be explained hereinafter.

In a preferred embodiment of the invention, the first conductive segment 110 is constructed from nickel or a nickel alloy that can be, and preferably is, silver-plated and the back-up spring 220 is a material other than nickel or a nickel alloy, preferably, stainless steel. The dual-material contact 100 thus takes advantage of the excellent electrically conductive qualities of the silver-plated nickel and/or nickel alloy and the consistent force providing capabilities of the stainless steel back up spring which, as taught herein, can have the spring beam portion 260 tailored to provide a desired force upon the electrically conductive segment 110.

While the contact 100 can be employed in many situations, it is suited for use with lamps of high power that utilize sockets of high temperature resistant materials, such as ceramics.

Figure 7:
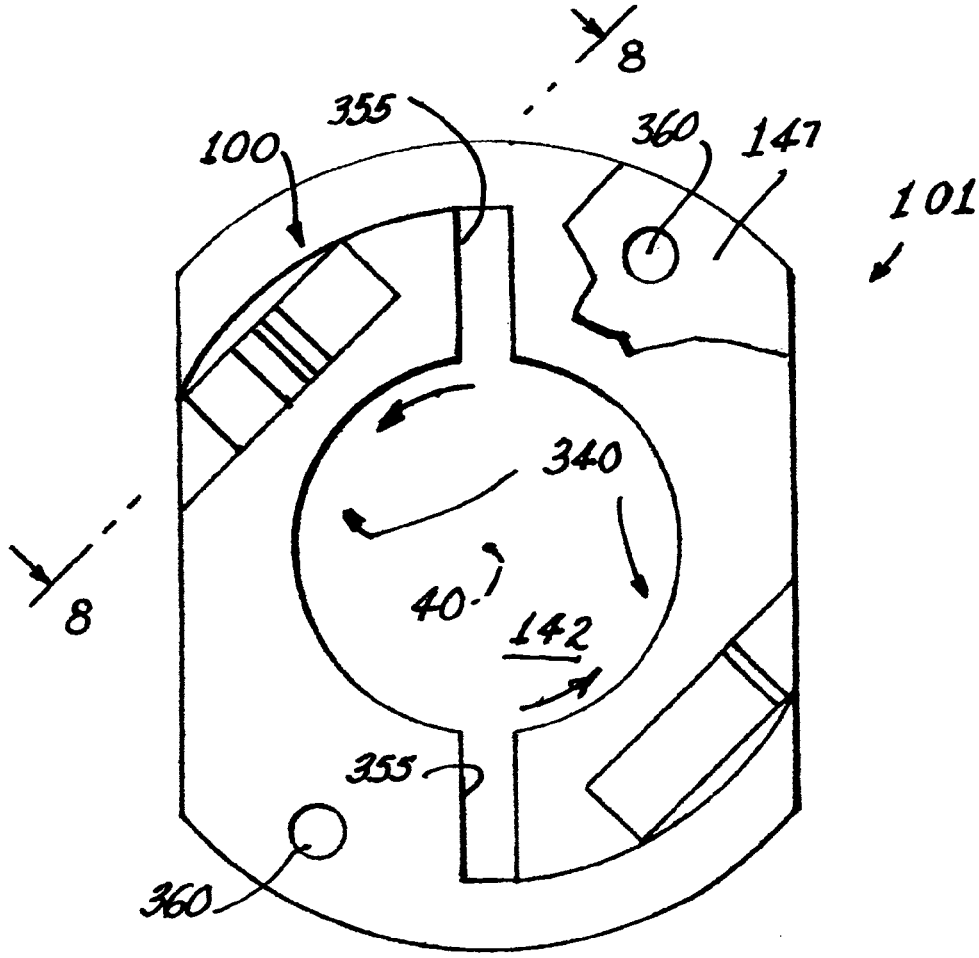
FIG. 7 is a plan view of a socket.
Figure 8:
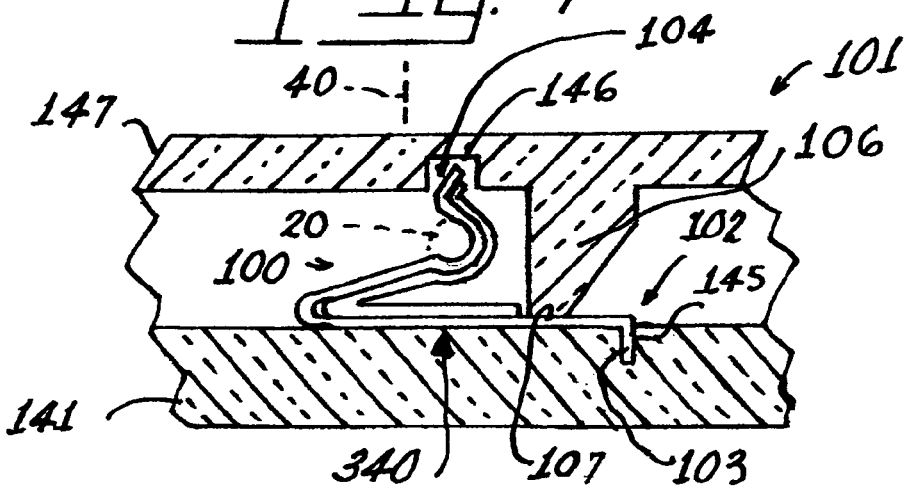
FIG. 8 is a partial sectional view taken along the line 8-8 if FIG. 7.

For example, such a construction is shown in FIGS. 7 and 8 wherein there is illustrated a socket 101 for receiving a lamp 10 and providing electrical connection to electrical lead-ins 20 of the lamp 10 that project away from a longitudinal lamp axis 40 of the lamp. The socket 101 is preferably constructed from a high temperature ceramic material, such as, for example, Steatite, and comprises a first socket body portion 141 that is arrayed about the lamp longitudinal axis 40 and includes a receptacle 142 aligned with the longitudinal axis 40 for receiving a portion of the lamp 10. A pair of opposed contact receiving areas 340 are formed in a first socket body portion 141 and each contact receiving area 340 includes a slot 145 formed therein. A second socket body portion 147 is arrayed about the lamp longitudinal axis 40 and fitted to the first socket body portion 141 to form the socket 101. Lamp lead-in receptors 355 are formed in at least one of the first or second socket body portions to received the lamp lead-ins 20 when a lamp 10 is inserted into the socket 101. Apertures 360 are provided both socket portions inserting bolts, gaskets or other structure to maintain the socket portions in a fixed relationship.

An elongated slot 146 is formed in the second body portion 147 and electrical contacts 100 are positioned in the contact receiving areas 340 between the first socket body portion 141 and the second socket body portion 147. The proximal portion 102 of the electrical contact 100 has first locating tab 103 positioned in the slot 145 and the distal portion 104 has its second locating tab 105 positioned in the elongated slot 146.

The second socket body portion 147 includes a member 106 that extends from an inner surface thereof and has an end 107 in engagement with the first segment 102 of the contact 100. The member 106 and the first locating tab 103 and slot 145 serve to maintain the contact 100 in position. This latter arrangement is best seen in FIG. 8.

FIG. 8 shows a lamp lead-in 20 in phantom lines in position in the contact 100 when a lamp 10 is place. In addition to holding and maintaining the lamp lead-ins 20, the configuration of the second re-entrant portion 160, the second beam 170 and electrical lead-in engager 150 of the electrical contact 100 combine to provide an audible and/or tactile indication to the person inserting the lamp that the lamp is properly and completely positioned within the socket 101.

The elongated slot 146 allows for movement of the distal portion 104 and the second locating tab 105 when a lamp 10 is inserted, thus preventing any binding.

Thus, there is provided an electrical contact for high power lamps that includes a first material to provide excellent electrical conductivity and a second material to provide tension. Additionally, the configuration of the second back-up spring 220 allows for the first spring beam 260 to take any of multiple forms that can be selected to provide specific tensioning requirements.

While there have been shown and described what are at present considered to be the preferred embodiments of the invention, it will be apparent to those skilled in the art that various changes and modifications can be made herein without departing from the scope of the invention as defined by the appended claims.

GLOSSARY OF TERMS AND REFERENCE NUMERALS USED HEREIN

| | |
|---|---|
| 10 | lamp |
| 20 | lamp lead-ins |
| 40 | longitudinal axis |
| 100 | electrical contact |
| 101 | socket |
| 102 | proximal portion of 100 |
| 103 | first locating tab |
| 104 | distal portion of 100 |
| 105 | second locating tab |
| 106 | member on 147 |
| 107 | end of 106 in contact with 120 |
| 110 | conductive segment of 100 |
| 120 | first segment of 100 |
| 130 | first reentrant portion of 100 |
| 140 | first beam of 100 |
| 141 | first socket body portion |
| 142 | receptacle for lamp |
| 144 | lead-in receptacles |
| 145 | slot for first locating tab 103 |
| 146 | elongated slot for second locating tab 105 |
| 147 | second socket body portion |
| 150 | lead-in engager formed on 100 |
| 160 | second reentrant portion of 100 |
| 170 | second beam of 100 |
| 220 | back-up spring |
| 240 | spring first segment of 220 |
| 250 | first spring reentrant portion |
| 260 | first spring beam |
| 261 | junction between 260 and 270 |
| 270 | second spring reentrant portion |
| 280 | second spring beam |
| 290 | given width of 260 |
| 300 | narrow neck of 260 |
| 320 | cut-out formed in 260 |
| 340 | contact receiving area in 141 |
| 350 | first gap |
| 351 | second gap |
| 353 | third gap |
| 355 | lamp lead-in slot |

What is claimed is:

1. An electrical contact (100) for a lamp (10) that includes electrical lead-ins (20) projecting away from a longitudinal lamp axis (40), said electrical contact 100 comprising:

a first electrically conductive segment (110) including a first segment (120) leading to a first reentrant portion (130);

a first beam (140) extending from said first reentrant portion (130) to an electrical lead-in engager (150);

a second reentrant portion (160) connecting to a second beam (170) that at least partially extends over said electrical lead-in engager (150); and a back-up spring (220) having a configuration substantially conforming to said electrical contact (100) and comprising a spring first segment (240) leading to a first spring reentrant portion (250), a first spring beam (260) extending from said first spring reentrant portion (250) to a junction (261) said junction (261) connecting said first spring beam (260) to a second spring reentrant portion (270), said second spring reentrant portion (270) connecting to a second spring beam (280) that abuts said second beam (170); and wherein a first gap (350) is defined between a portion of said conductive segment (110) and a portion of said back-up spring (220) at a region of said first reentrant portion (130);

a second gap (351) is defined between a portion of said electrical lead-in engager (150) of said conductive segment (110) and a portion of said junction (261) of said back-up spring (220); and a third gap (352) is defined between a portion of said second beam (170) of said conductive segment (110) and a portion of said second spring re-entrant portion (270) at a region of said second reentrant portion (160) of said conductive segment (110).

2. The electrical contact (100) of claim 1 wherein said first spring beam (260) is formed id provide a pre-selected force to said back-up spring (220).

3. The electrical contact (100) of claim 1 wherein said back-up spring (220) comprises a single strand wire spring.

4. The electrical contact (100) of claim 1 wherein said contact (100) has a proximal portion (102) including a first locating tab (103) and a distal portion (104) including a second locating tab (105).

5. The electrical contact (100) of claim 1 wherein said first conductive segment (110) comprises a first material comprising nickel or an alloy thereof, and said back-up spring (220) comprises a second material dissimilar to said first material.

6. The electrical contact (100) of claim 5 wherein said back-up spring (220) comprises stainless steel.

7. An electrical contact (100) for a lamp (10) that includes electrical lead-ins (20) projecting away from a longitudinal lamp axis (40), said electrical contact 100 comprising:

a first electrically conductive segment (110) including a first segment (120) leading to a first reentrant portion (130);

a first beam (140) extending from said first reentrant portion (130) to an electrical lead-in engager (150);

a second reentrant portion (160) connecting to a second beam (170) that at least partially extends over said electrical lead-in engager (150); and a back-up spring (220) having a configuration substantially conforming to said electrical contact (100) and comprising a spring first segment (240) leading to a first spring reentrant portion (250), a first spring beam (260) extending from said first spring reentrant portion (250) to a junction (261) said junction (261) connecting said first spring beam (260) to a second spring reentrant portion (270), said second spring reentrant portion (270) connecting to a second spring beam (280) that abuts said second beam (170); and wherein said first spring beam (260) comprises a region having a first width (290) adjacent a region defining a neck (300) having a neck width less than said first width (290) wherein said neck width is chosen to select a force exerted by said back-up spring (220) on said conductive segment (110).

8. An electrical contact (100) for a lamp (10) that includes electrical lead-ins (20) projecting away from a longitudinal lamp axis (40), said electrical contact 100 comprising:

a first electrically conductive segment (110) including a first segment (120) leading to a first reentrant portion (130);

a first beam (140) extending from said first reentrant portion (130) to an electrical lead-in engager (150);

a second reentrant portion (160) connecting to a second beam (170) that at least partially extends over said electrical lead-in engager (150); and a back-up spring (220) having a configuration substantially conforming to said electrical contact (100) and comprising a spring first segment (240) leading to a first spring reentrant portion (250), a first spring beam (260) extending from said first spring reentrant portion (250) to a junction (261) said junction (261) connecting said first spring beam (260) to a second spring reentrant portion (270), said second spring reentrant portion (270) connecting to a second spring beam (280) that abuts said second beam (170); and wherein said first spring beam (260) defines a cut-out (320) formed therein, wherein dimensions of said cut-out (320) are chosen to select a force exerted by said back-up spring (220) on said conductive segment (110).

9. An electrical contact (100) for a lamp (10) that includes electrical lead-ins (20) projecting away from, a longitudinal lamp axis (40) in combination with a socket (101) for receiving a lamp (10), said electrical contact 100 comprising:

a first electrically conductive segment (110) including a first segment (120) leading to a first reentrant portion (130);

a first beam (140) extending from said first reentrant portion (130) to an electrical lead-in engager (150);

a second reentrant portion (160) connecting to a second beam (170) that at least partially extends over said electrical lead-in engager (150); and a back-up spring (220) having a configuration substantially conforming to said electrical contact (100) and comprising a spring first segment (240) leading to a first spring reentrant portion (250), a first spring beam (260) extending from said first spring reentrant portion (250) to a junction (261) said junction (261) connecting said first spring beam (260) to a second spring reentrant portion (270), said second spring reentrant portion (270) connecting to a second spring beam (280) that abuts said second beam (170); and said socket (101) comprising a first socket body portion (141) and a second socket body portion (147), said electrical contact (100) being disposed between said first and second body portions.

10. The electrical contact (100) of claim 9 wherein at least one gap (350; 351; 352) is defined between a portion of said first electrically conductive segment (110) and an adjacent portion of said back-up spring (220).

11. A socket (101) for receiving a lamp (10) and providing electrical connection to electrical lead-ins (20) of said lamp (10) that project away from a longitudinal lamp axis (40), said socket comprising:

a first socket body portion (141) arrayed about said lamp longitudinal axis (40) and defining a receptacle (142) aligned with said longitudinal axis (40) for receiving a portion of the lamp (10);

a first slot (145) formed in said first socket body portion (141);

a second socket body portion (147) arrayed about said lamp longitudinal axis (40) and fitted to said first socket body portion (141);

a second slot (146) formed in said second body portion (147); and an electrical contact (100) positioned in said socket between said first socket body, portion (141) and said second socket body portion (147), said electrical contact (100) having a proximal portion (102) including a first locating tab (103) positioned in said first slot (145) and a distal portion (104) including a second locating tab (105) positioned in said second slot (146).

12. The socket (101) of claim 11 wherein said electrical contact (100) comprises a first segment (120) adjacent said proximal portion (102) and said second body portion (147) includes a member (106) extending therefrom and having an end (107) in engagement with said first segment (120).

* * * * *